US011013280B2

(12) United States Patent
Lee et al.

(10) Patent No.: US 11,013,280 B2
(45) Date of Patent: May 25, 2021

(54) METHOD AND APPARATUS FOR MANUFACTURING FIBER FOR SYNTHETIC HAIR

(71) Applicant: Chang Moo Lee, Moonachie, NJ (US)

(72) Inventors: Chang Moo Lee, Moonachie, NJ (US); Han Soo Park, YangJu (KR)

(73) Assignee: Chang Moo Lee, Moonachie, NJ (US)

( * ) Notice: Subject to any disclaimer, the term of this patent is extended or adjusted under 35 U.S.C. 154(b) by 259 days.

(21) Appl. No.: 16/211,746

(22) Filed: Dec. 6, 2018

(65) Prior Publication Data

US 2020/0068971 A1 Mar. 5, 2020

(51) Int. Cl.

| | |
|---|---|
| ***D06M 23/02*** | (2006.01) |
| ***D01F 8/06*** | (2006.01) |
| ***D01F 8/12*** | (2006.01) |
| ***D01F 8/14*** | (2006.01) |
| ***D01F 8/16*** | (2006.01) |

(Continued)

(52) U.S. Cl.

CPC ..... *A41G 3/0083* (2013.01); *D06M 23/02* (2013.01); *D01F 8/06* (2013.01); *D01F 8/12* (2013.01); *D01F 8/14* (2013.01); *D01F 8/16* (2013.01); *D06B 11/0059* (2013.01);

(Continued)

(58) Field of Classification Search

CPC .... A41G 3/0083; D06M 23/02; D06M 16/00; D06M 23/06; D06M 2101/20; D06M 2101/32; D06M 2200/50; D06M 10/001; D01F 8/06; D01F 8/12; D01F 8/14; D01F 8/16; D01F 6/62; D06B 11/0059; D06B 3/04; D06C 7/00; D01D 10/00; D01D 10/02; D01D 1/00; D01D 5/08; A61L 2/10; D02J 13/00; D10B 2401/13; D10B 2503/08

See application file for complete search history.

(56) References Cited

U.S. PATENT DOCUMENTS 6,746,641 B1 * 6/2004 Gunkel ..... D01F 13/02 264/464

9,233,392 B2 1/2016 Han (Continued)

FOREIGN PATENT DOCUMENTS

KR 10-1241395 B1 3/2013

WO WO-2017114585 A1 * 7/2017 ..... A61F 13/15268

*Primary Examiner* — Jeffrey M Wollschlager

(74) *Attorney, Agent, or Firm* — John H. Choi & Associates

(57) ABSTRACT

A method and apparatus fabricate synthetic hair by mixing a raw material to form a mixed material; sterilizing the mixed material to form a sterilized material; melting the sterilized material to form a melted material; yarning the melted material to form a yarn material; sterilizing the yarn material to form an intermediate sterilized yarn; heating the sterilized yarn to form a heated yarn; and sterilizing the heated yarn to form a final sterilized yarn. Sterilizing of the mixed material, the yarn material, and/or the heated yarn includes: sterilizing using an ultraviolet (UV) lamp. Heating of the sterilized yarn is performed by a heating device selected from a heated roller, a heating plate, a steam jet device, and a hot water reservoir. Alternatively, sterilizing of the heated yarn includes: immersing the heated yarn into an immersion device, which includes an antibacterial solution. The final sterilized yarn forms a synthetic hair.

7 Claims, 2 Drawing Sheets

(51) Int. Cl.

| | |
|---|---|
| ***D06B 11/00*** | (2006.01) |
| ***D06M 16/00*** | (2006.01) |
| ***D06M 23/06*** | (2006.01) |
| ***D06M 101/20*** | (2006.01) |
| ***D06M 101/32*** | (2006.01) |
| ***A41G 3/00*** | (2006.01) |

(52) U.S. Cl.
CPC ..... *D06M 16/00* (2013.01); *D06M 23/06* (2013.01); *D06M 2101/20* (2013.01); *D06M 2101/32* (2013.01)

(56) References Cited

U.S. PATENT DOCUMENTS

| | | | | |
|---|---|---|---|---|
| 2002/0008331 | A1* | 1/2002 | Feilmair | D01F 2/00 264/145 |
| 2008/0085957 | A1* | 4/2008 | Masuda | D01F 6/62 524/119 |
| 2016/0302504 | A1* | 10/2016 | Toki | A41G 3/0083 |
| 2018/0368401 | A1* | 12/2018 | Swamy | A01N 43/16 |

* cited by examiner

METHOD AND APPARATUS FOR MANUFACTURING FIBER FOR SYNTHETIC HAIR

CROSS-REFERENCE TO RELATED APPLICATION

This application claims priority to Korean Application No. 10-2018-0105761, filed on Sep. 5, 2018, which is incorporated by reference in its entirety.

FIELD

The present disclosure relates to synthetic hair and in particular to a method and apparatus for manufacturing fiber for synthetic hair.

BACKGROUND

Synthetic hair is used for many purposes, such as to conceal hair loss, or to have fuller looking hair for the purpose of improving beauty. Depending on the usage, synthetic hair can be classified into full wigs, toupees, hair extensions, etc., and wigs may be further classified into medical wigs, fashion wigs, etc. Synthetic hair can also be classified depending on how the wearer wears such synthetic hair, such as being removable, or having the purpose of being continuously worn.

In general, hair loss may be caused by genetics, stress, severe damage or injury to a person's head, or due to various diseases, and such causes are partially the reasons for hair loss replacement that results in all sorts of wigs being used to hide the affected area.

In recent years, to cover up hair loss, burns, scars, etc. or just for the purpose of improving beauty, various kinds of wigs are used which are composed of actual human hair or composed of artificial hair made from synthetic fiber. In order to meet a variety of hair styles, synthetic hair fibers are popular in hair products currently on the market.

Synthetic hair may also be implanted into the scalp of the user, or otherwise adhered to the scalp of the user by adhesive or other substances. Unfortunately, in the prior art, there is a probability that synthetic hair may be contaminated by bacteria, fungi due to sweat or other body secretions, pollution, dirt, impurities from the external environment, etc., all of which can cause hygiene and health issues to the user of synthetic hair.

In the prior art, in order to resolve these health issues, ultrasonic spray devices are known which are used on synthetic fibers to have antibacterial and antifungal effects. However, this kind of spraying method in the prior art merely covers the surface of the synthetic hair, and so is unable to prolong anti-bacterial functions consistently, and germicidal efficacy is consistently low. Therefore, extended use of synthetic hair can easily create germs which are allowed to proliferate in view of the limitations of prior art germicidal devices or substances.

Another problem with synthetic hair fibers in the prior art is that the fibers are too thick or dense, normally about 40 Denier. Thus, the raw material required to manufacture the fibers are costly, and the fibers or yarn on a finished product such as a hair piece is difficult to manage due to the density and weight.

Therefore, a light-weight and sterile fiber for synthetic hair is needed, along with a cost-effective way of manufacturing the same.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention produces and provides devices to supply the special synthetic fibers with consistent antimicrobial and antibacterial effects, and not to affect any hygiene and health problems of the users of the synthetic fibers used as synthetic hair.

The present invention is directed to how to manufacture artificial hair fiber, by a mixing of raw materials with colorants, performing a first UV sterilization process, performing melting and yarning of the mixed sterilized materials, performing a second UV sterilization process with the yarned fibers, performing a heat treatment, and then performing a third sterilization process by soaking the fibers in an antibacterial solution.

In one embodiment, the present invention is a method including: mixing a raw material to form a mixed material; sterilizing the mixed material to form a sterilized material; melting the sterilized material to form a melted material; yarning the melted material to form a yarn material; sterilizing the yarn material to form an intermediate sterilized yarn; heating the sterilized yarn to form a heated yarn; and sterilizing the heated yarn to form a final sterilized yarn. Sterilizing of the mixed material, the yarn material, and/or the heated yarn includes: sterilizing using an ultraviolet (UV) lamp. Heating of the sterilized yarn is performed by a heating device selected from a heated roller, a heating plate, a steam jet device, and a hot water reservoir. Alternatively, sterilizing of the heated yarn includes: immersing the heated yarn into an immersion device, which includes an antibacterial solution. The final sterilized yarn forms a synthetic hair having a linear mass density of about 15 Denier.

In another embodiment, the present invention is a method including: processing a raw material to form processed material; and performing at least three stages of sterilization of the processed material to form a sterilized yarn. Each stage of sterilization includes: sterilizing using an ultraviolet (UV) lamp. Alternatively, at least one stage of sterilization includes: sterilizing by immersion into an immersion device which includes an antibacterial solution. The method further includes heating the processed material by a heating device selected from a heated roller, a heating plate, a steam jet device, and a hot water reservoir. The sterilized yarn forms a synthetic hair.

In a further embodiment, the present invention is an apparatus including: a mixing stage for mixing a raw material to form a mixed material; a first sterilizer for sterilizing the mixed material to form a sterilized material; a yarning device for melting the sterilized material to form a melted material, and for yarning the melted material to form a yarn material; a second sterilizer for sterilizing the yarn material to form an intermediate sterilized yarn; a heating device for heating the sterilized yarn to form a heated yarn; and a third sterilizer for sterilizing the heated yarn to form a final sterilized yarn. At least two of the first, second, and third sterilizers are ultraviolet (UV) lamps. Alternatively, the third sterilizer is an immersion device which includes an antibacterial solution. The heating device is selected from a heated roller, a heating plate, a steam jet device, and a hot water reservoir. The final sterilized yarn forms a synthetic hair having a linear mass density of about 15 Denier.

According to the present invention, the described manufacturing processes and devices produce artificial hair fibers with consistent antimicrobial and antibacterial effects, and with prevention of harmful effects on the user's hygiene and health.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

Figure 1:
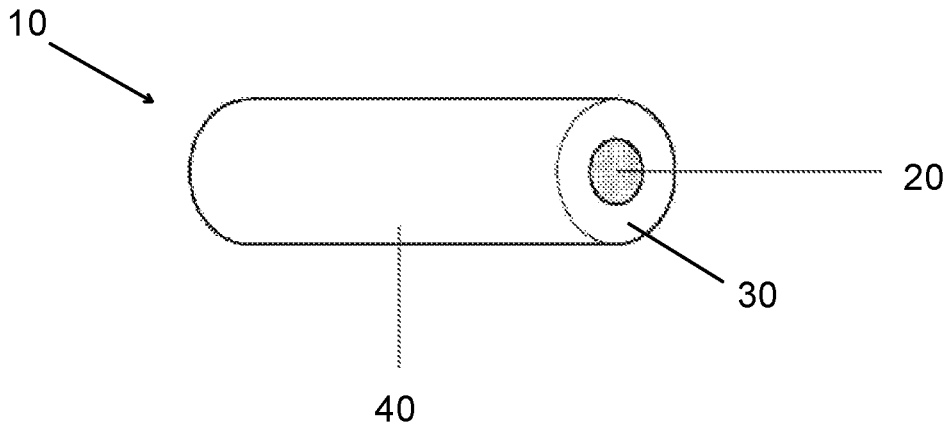
FIG. 1 illustrates a yarned synthetic hair.

To facilitate an understanding of the invention, identical reference numerals have been used, when appropriate, to designate the same or similar elements that are common to the figures. Further, unless stated otherwise, the features shown in the figures are not drawn to scale but are shown for illustrative purposes only.

DETAILED DESCRIPTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left may be used to describe the accompanying figures. The terminology includes the words above specifically mentioned, derivatives thereof, and words of similar import.

Referring to FIG. 1, the present invention forms a yarned synthetic hair 10 with a sheath-and-core structure. The core yarn 20 is composed of one or more elements within the group of polyolefin, polyamide, polyester, polyvinylchloride, polymodacryl, and polypropylene. The sheath structure 30 wraps around the core yarn 20. The sheath structure 30 forms the surface 40 of the yarned synthetic hair 10, so that the surface 40 may include fabric softener and/or an antibacterial agent.

Figure 3:
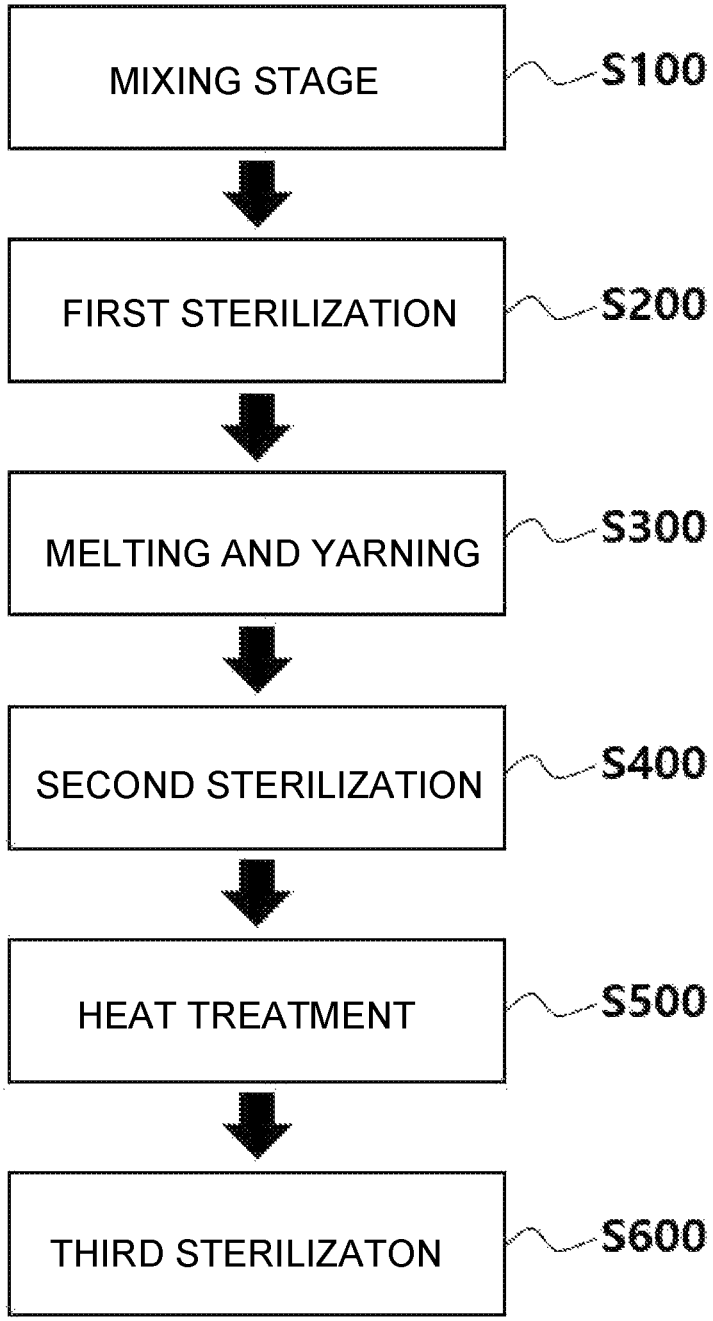
FIG. 3 is a flowchart of a method of the present invention for manufacturing and cleaning the synthetic hair.

Referring to FIG. 3, the method of the present invention manufactures the artificial/synthetic hair yarn by starting with a mixing stage by color mixing the raw materials in step S100, performing a first disinfection sterilization by, for example, applying ultraviolet light in step S200, performing a melting and yarning stage with the sterilized raw materials in step S300, performing a second sterilization by, for example, applying ultraviolet light to the yarn in step S400, performing heat treatment to the sterilized yarn in step S500, and performing a third disinfection sterilization by soaking the heat-treated yarn with an antibacterial solution to sterilize the yarn in step S600.

Figure 2:
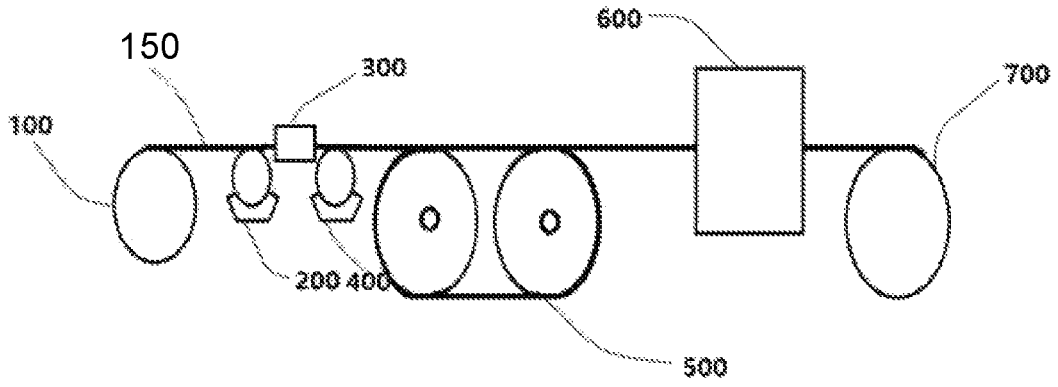
FIG. 2 illustrates a system of the present invention for manufacturing and cleaning the synthetic hair.

Referring to FIG. 2 in conjunction with FIG. 3, in step S100, raw materials and color dyes can be mixed into a bucket 100 through hopper tubes to form mixed and colored processed materials 150. The mixed materials 150 are fed from the top or upper part of the material bucket 100 to an ultraviolet (UV) lighting device 200, such as a UV lamp, as a first sterilization device to perform step S200. A reflector-focusing or condensing mechanism can be included in the UV lighting device 200 to minimize light leakage so that light emitting efficiency can be achieved. In addition, the first sterilization device 200 operates to perform step S200 depending on the type of raw material bucket 100 and the location of the upper part of the raw material bucket 100 from which the mixed materials 150 are fed. The upper part of the bucket 100 can be formed in the shape of a lid cover acting as a lid for the bucket 100, and the lid cover can be composed of one to four UV lamps to act as the UV lighting device 200.

The sterilized mixed materials 150 are fed from the UV lighting device 200 to pass through a device 300 for melting and yarning the mixed materials 150 at predetermined temperatures by melting the raw materials, performed by the melting and yarning step S300. For example, by passing the raw materials of composition to be melted in the range of 200° C. to 300° C., the composition of the materials 150, such as polyesteric materials, are yarned by the heat radiation from the device 300. The melted and yarned material is then fed to an extruder, to a gear pump, and through a nozzle orifice, to be cooled below an extrication transition point (Tg), such that yarn can be produced from the device 300 at a rate ranging from 50 m/min. to 5000 m/min. After leaving the device 300, the melted and yarned composition may be fed into a cooling container by which an operator can control the temperature for cooling the yarned materials 150.

The manufacture of the product; that is, the melted and yarned material, can be controlled by controlling extruding volume, by controlling the number of orifice holes, by checking the temperature or length of raw material being fed from the bucket 100, by controlling the temperature of cooling air and the amount of air, by controlling the temperature of a cooling water container, cooling time, extruding speed, etc.

Then, the cooled yarn from the device 300 is sterilized by a second sterilization device 400 in step S400. The second sterilization device 400 may be a second UV lamp. In particular, the second sterilization device 400 may be the same as the first sterilization device 200, being one or more UV lamps with a condensing-type reflector for improved lighting efficiency. The second sterilization device 400 may consist of, for example, one to three UV lamps, while the first sterilization device 200 may consist of, for example, one to four UV lamps.

The sterilized yarn from the second sterilization device 400 is then heat treated in step S500 using a heating device 500. The heat treatment can be executed by a continuous direct yarning method using the heating device 500 which may be a heated roller, a heating plate, a steam jet device, a hot water reservoir, or a combination of such heating devices. In performing the heat treatment by the heating device 500, the yarn may be elongated by a one-step method or a two-steps method, with an ideal elongation temperature being higher than the extrication transition point (Tg) of the base materials forming the yarn, such as a base polyesteric composition having an extrication transition point, for example, of about 110° C. In addition, the yarn treated at high temperature can be formed into synthetic hair at a regular steady thickness.

The elongated or stretched yarn then undergoes a third sterilization step S600, by which the yarn is immersed into an immersion device 600 containing a fabric softener and an antibacterial solution. For example, the immersion device may have a concave shape to dip all of the portions of the yarn, including the top and bottom of the yarn, into the fabric softener and antibacterial solution.

The antibacterial solution may have 1.5% to 2% by weight of an antibacterial substance dissolved in water. An optional binder known in the art can be mixed into the antibacterial solution, if necessary or desired. Thus, the antibacterial solution has an additional sterilization effect on the yarn. In an alternative embodiment, the immersion device 600 may be replaced with other sterilization devices, such as one or more UV lamps.

After the third sterilization in step S600, the yarn can be processed through a tension control roller 700, which may have a constant direction and speed of rotation. In an example embodiment, the roller 700 has a cylindrical form, and because it is round, the yarn can be fixed with bend to form a synthetic hair yarn. Thus, according to the present invention, the synthetic hair yarn formed by the apparatus in FIG. 2 grants a natural steady thickness and fuller-looking appearance just like natural human hair. In addition, through the use of multiple sterilization steps S200, S400, and S600 in FIG. 3 using the sterilization devices 200, 400, 600 in FIG. 2, respectively, the apparatus enables the manufacture of synthetic hair with a constant and significant antibacterial effect and blocks any harmful effects to the user in terms of hygiene and health.

Fiber manufactured using the method of the present invention has been tested by the Korea Apparel Testing & Research Institute (KATRI). In a first test, the fiber of the present invention was immersed in a bacteria solution consisting *Staphylococcus aureus* (ATTC6538) having a density of $1.3\times10^5$ CFU/mL. The fiber was then washed with a soft agent soap and measured for sterility. The fiber was found to be greater than 99.9 percent sterile, which exceeded the 90 percent standard for sterility. In a second test, the fiber of the present invention was immersed in a bacteria solution consisting *Klebsiella pneumoniae* (ATCC 4352) having a density of $1.3\times10^5$ CFU/mL. The fiber was then washed with a soft agent soap and measured for sterility. The fiber was found to be greater than 99.9 percent sterile, which exceeded the 90 percent standard for sterility.

The method of the present invention provides a cost-effective way of manufacturing a sterile fiber or yarn. Moreover, the fibers or yarn manufactured using the method of the present invention have a linear mass density or Denier of about 15. Thus, the present invention provides a light-weight and sterile fiber for synthetic hair.

The present invention may be embodied in other specific forms without departing from its spirit or essential characteristics. The described embodiments are to be considered in all respects only as illustrative and not restrictive. The scope of the invention, therefore, will be indicated by claims rather than by the foregoing description. All changes, which come within the meaning and range of equivalency of the claims, are to be embraced within their scope.

What is claimed is:

1. A method comprising:

mixing a raw material to form a mixed material;

sterilizing the mixed material to form a sterilized material;

melting the sterilized material to form a melted material;

yarning the melted material to form a yarn material;

sterilizing the yarn material to form an intermediate sterilized yarn;

heating the sterilized yarn to form a heated yarn; and sterilizing the heated yarn to form a final sterilized yarn.

2. The method of claim 1, wherein the sterilizing of the mixed material includes:

sterilizing using an ultraviolet (UV) lamp.

3. The method of claim 1, wherein the sterilizing of the yarn material includes:

sterilizing using an ultraviolet (UV) lamp.

4. The method of claim 1, wherein the sterilizing of the heated yarn includes:

sterilizing using an ultraviolet (UV) lamp.

5. The method of claim 1, wherein the final sterilized yarn forms a synthetic hair having a linear mass density of about 15 Denier.

6. The method of claim 1, wherein the sterilizing of the heated yarn includes:

immersing the heated yarn into an immersion device.

7. The method of claim 6, wherein the immersion device includes an antibacterial solution.

* * * * *